United States Patent [19]

Rohrbach

[11] Patent Number: 4,558,657

[45] Date of Patent: Dec. 17, 1985

[54] SPRAYING APPARATUS

[75] Inventor: Walter Rohrbach, Burnsville, Minn.

[73] Assignee: Midwest Automation, Inc., Minneapolis, Minn.

[21] Appl. No.: 168,756

[22] Filed: Jul. 11, 1980

[51] Int. Cl.[4] ..... B05C 5/00

[52] U.S. Cl. ..... 118/70; 118/324; 118/326

[58] Field of Search ..... 118/323, 324, 325, 70, 118/326

[56] References Cited

U.S. PATENT DOCUMENTS

| | | | |
|---|---|---|---|
| 3,270,711 | 9/1966 | Leach | 118/326 X |
| 3,296,052 | 1/1967 | Bechtold . | |
| 3,296,056 | 1/1967 | Bechtold . | |
| 3,424,129 | 1/1969 | Peeps et al. | 118/323 X |
| 3,516,388 | 6/1970 | Barnes | 118/326 X |
| 3,739,745 | 6/1973 | Turpin | 118/70 X |
| 3,885,066 | 5/1975 | Schwenninger | 118/323 X |
| 4,064,832 | 12/1977 | Chujo et al. | 118/323 |
| 4,239,809 | 12/1980 | Lampkin et al. | 427/74 |

OTHER PUBLICATIONS

Bechtold Engineering Co. brochure No. 2132-2M-85-rev.

Roberts Consolidated Industries, Inc. brochure No. 2343-5M-89.

*Primary Examiner*—John P. McIntosh

*Attorney, Agent, or Firm*—James R. Haller

[57] ABSTRACT

A spraying apparatus for spraying a particle-laden fluid upon a workpiece. The apparatus includes a spray compartment, spray gun means in the compartment, exhaust means for exhausting air-entrained particles, and means for flowing air past the spray gun means to prevent air-entrained particles from returning to the spary gun means. The exhaust means may include means for abruptly changing the direction of air entraining the sprayed particles from a direction generally toward the workpiece to be sprayed to a direction generally away from the workpiece, whereby the air-entrained particles are urged into contact with the workpiece.

6 Claims, 3 Drawing Figures

10
16.1
16.3
16.5
16.6
16.8
16.31
16.2
16.4
18.6
19.2
20.3
19.3
18.1
20.4
18
14
14.2
14.1
14.4
14.7
14.5
14.3
16
12
12.1
2
2

SPRAYING APPARATUS

TECHNICAL FIELD

The invention relates to spraying devices of the type used to apply sprayed particles, such as result from spraying latex adhesives, upon workpieces such as cores and laminate sheets for use, for example, in the manufacture of kitchen countertops and other laminated articles.

BACKGROUND ART

Liquids generally are sprayed by entraining the liquids in air through a spray nozzle, or by an airless technique in which only the liquid emerges from the spray gun. One such device employs a spray compartment having an open bottom past which is transported a workpiece. One or more spray guns within the compartment spray liquid downwardly upon the workpiece. When a liquid such as a latex adhesive is sprayed, a mist of wet adhesive particles may spread through the compartment and some of the particles may be deposited upon the spray gun or the associated structure and have the effect of clogging, or reducing the efficiency of, the associated spray gun structure, all of which then requires frequent maintenance. Further, the particulate mist may escape from the spray compartment into the surrounding work area with consequent pollution problems.

DISCLOSURE OF INVENTION

The present invention provides a spraying apparatus for applying sprayed particles upon a workpiece. The apparatus includes means defining a spray compartment having an opening defining a workpiece spraying station, and spray gun means in the compartment and oriented to spray a fluid such as a latex adhesive onto a workpiece in the workpiece spraying station. Provided also are exhaust means for exhausting air-entrained, sprayed particles from adjacent the spraying station and means providing a flow of air past the spray gun means generally toward the workpiece of sufficient force as to prevent sprayed particles from returning to the spray gun means. The exhaust means desirably includes means cooperating with the workpiece to abruptly change the direction of air containing entrained sprayed particles from a first direction generally toward the workpiece to a second direction generally away from the workpiece to urge the particles into contact with the workpiece. The exhaust means desirably includes an exhaust blower or fan for creating a partial vacuum within the exhaust means. Conveyor means may be provided to convey the workpiece continuously into and out of the workpiece spraying station.

BEST MODE FOR CARRYING OUT THE INVENTION

In the manufacture of kitchen countertops and the like, a thin, decorative, protective plastic laminate is formed and adherred to a supportive core of, for example, pressed wood, plastic, plywood, particle board or even steel. The manufacturing procedure may involve the steps of applying adhesive to the top surface of the core, depending upon the adhesive system utilized, and also to the underside of the laminate; and centering the laminate upon the core to adhere the laminate sheet and core together. In the event the laminate sheet is to be wrapped about side edges of the core, the process will normally include heat-forming the edges of the laminate sheet to the edges of the core. The manufacturing process may be substantially continuous, the workpieces moving from an apparatus which applies adhesive serially or in parallel to the core and laminate sheets, to an apparatus which correctly applies the laminate to the top surface of the core and thence to an apparatus which forms the edges of the laminate to the core edges. The apparatus of the invention may be employed in the second-mentioned step.

Figure 1:
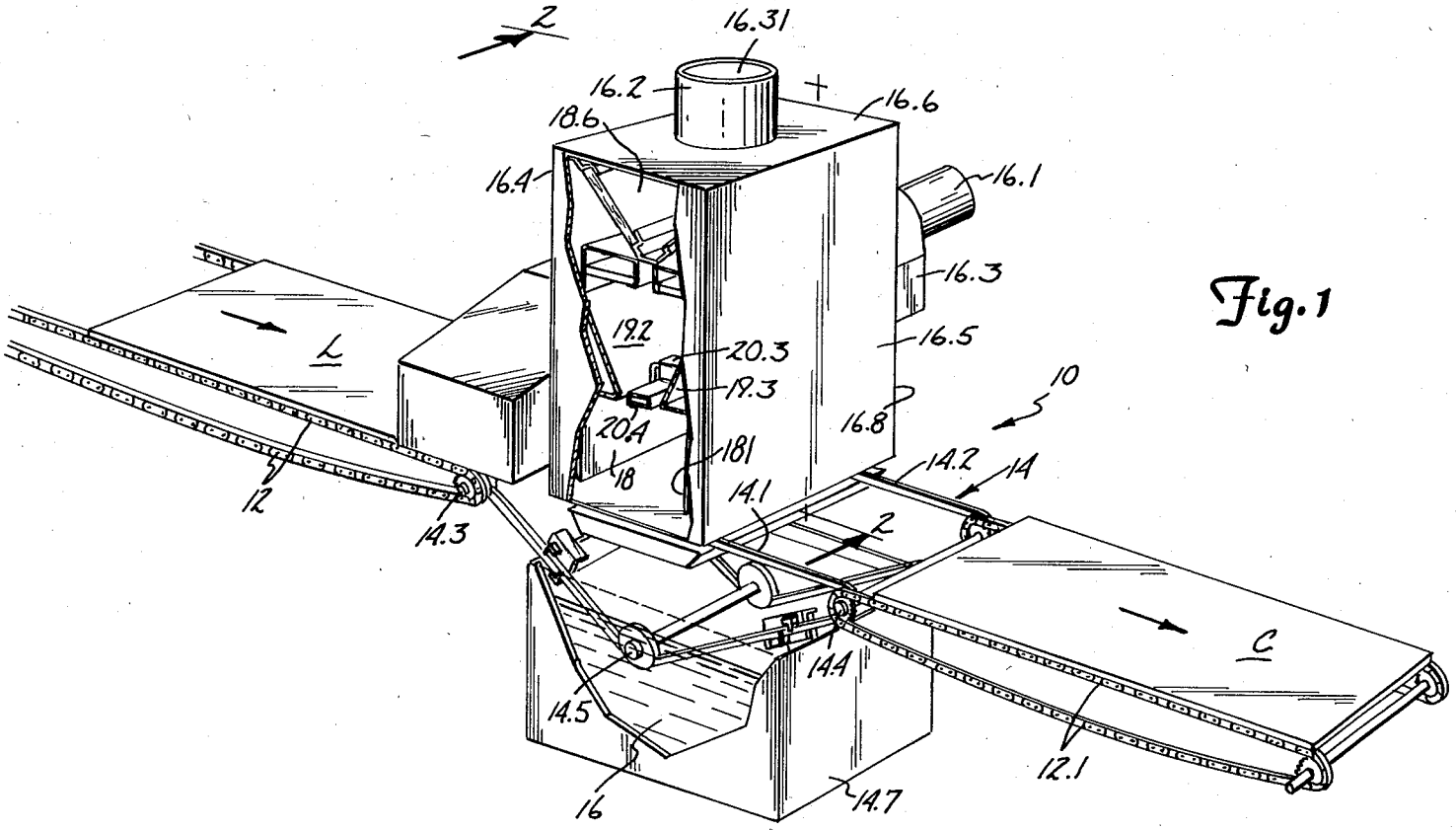
FIG. 1 is a perspective view, partially broken-away, of a spraying apparatus of the invention.

Referring to FIG. 1, an apparatus of the invention is shown generally as (10). A pair of conveyor belts (12) are shown for feeding flat core sections to the apparatus, and another set of conveyor belts (12.1) are shown for conveying the adhesive-coated core from the apparatus. In a substantially continuous manufacturing line, a machine for accurately sawing the sides of each core section would be placed directly upstream from the conveyor belts (12), and an apparatus for accurately applying a laminate sheet to the top of the core would be positioned downstream from the conveyor belts (12.1). In FIG. 1, one core section (C) is shown leaving the apparatus, and a laminate sheet (L) is shown about to enter the apparatus.

Conveyor means, shown generally in FIG. 1 as 14, are provided to convey the core sections and laminate sheets through the apparatus (10). The conveyor means typified in FIG. 1 comprises a pair of continuous, flexible cords (14.1, 14.2) arranged at either side of the line of travel of the workpiece through the apparatus. The continuous lengths of cord (14.1, 14.2) are parallel and are trained over pairs of guide wheels (14.3, 14.4) on either side of the apparatus. A third pair of wheels (14.5) is provided parallel to but below the aforementioned axles and is immersed in a bath (14.6) of solvent such as water for cleaning the cords, as will be described more fully below.

Figure 2:
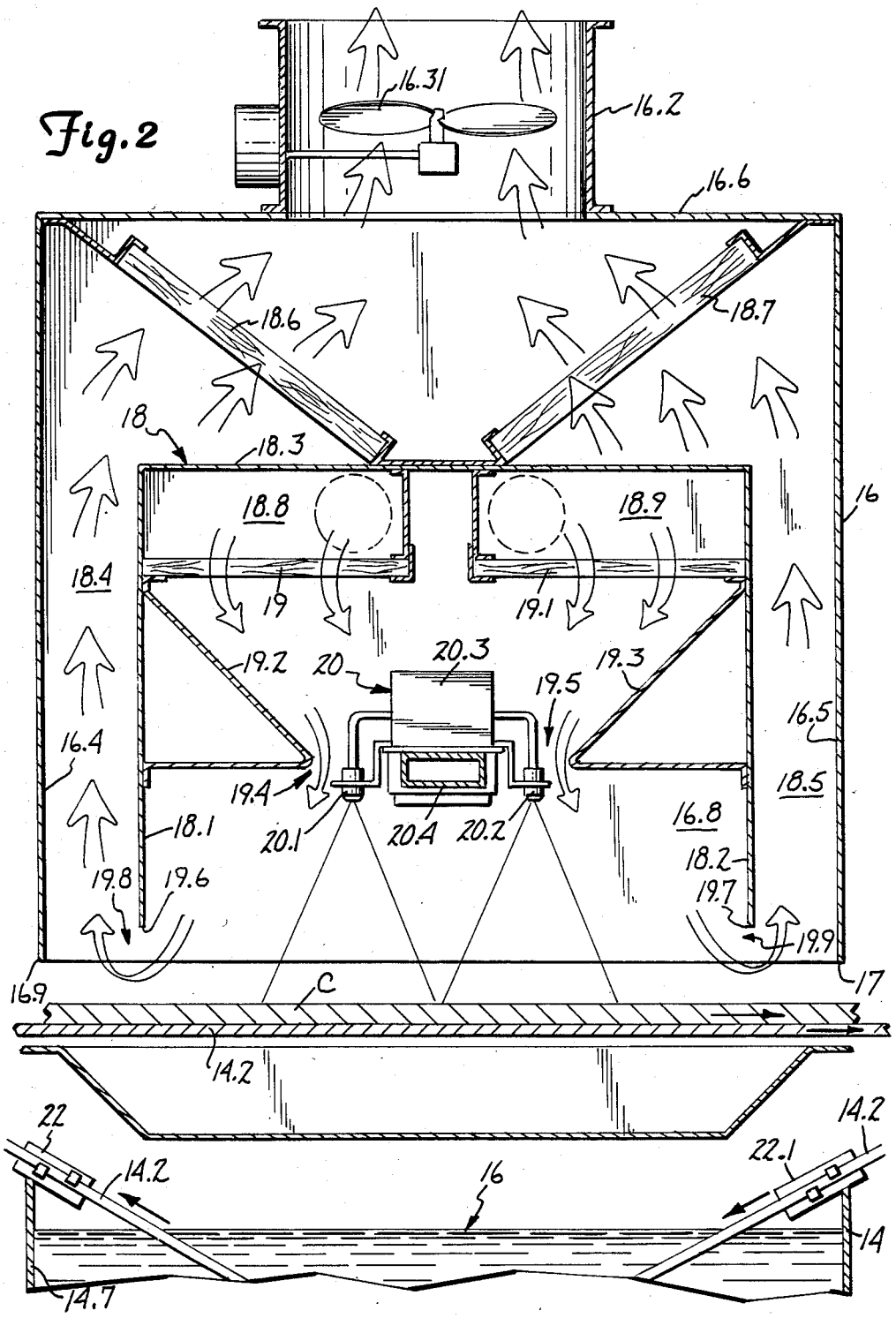
FIG. 2 is a cross-sectional view, partially broken-away, taken along line 2—2 of FIG. 1.

Referring now to FIGS. 1 and 2, immediately above the horizontal reach of the cords (14.1, 14.2) is positioned a housing (16) having air entry and exhaust ports (16.1, 16.2). A blower (16.3) is provided to force air under pressure through the port (16.1), and an exhaust blower (16.31 is mounted in the exhaust port 16.2 to create a partial vacuum and draw exhaust air from the housing. The housing has generally vertical front and rear walls (16.4, 16.5), a top wall (16.6), side walls (16.7, 16.8), and an open bottom. Mounted within the housing is a spray compartment (18) comprising generally vertical front and rear walls (18.1, 18.2) and a top wall (18.3). The side walls (16.7, 16.8) of the housing are also the side walls of the spray compartment. As shown best in FIG. 2, the front and rear walls (18.1, 18.2) of the spray compartment are spaced inwardly of the front and rear walls (16.4, 16.5) of the housing to form air exhaust passageways (18.4, 18.5) forwardly and rearwardly of the spray compartment. Filters (18.6, 18.7) are provided across the passageways (18.4, 18.5) at their upper ends and communicate the passageways with the exhaust port (16.2). The air intake port (16.1) communicates with generally horizontal passageways (18.8, 18.9) carried just under the top wall (18.3) of the spray compartment, the passageways having lower walls (19, 19.1) permitting air under pressure from within the passageways (18.8, 18.9) to flow downwardly. The bottom walls, (19, 19.1) may contain filters, may be entirely open, may be provided with openings such as perforations or louvers or the like or may form convergent passageways with the walls (18.3), all for the purpose of providing a generally uniform downwardly flow of air from the passageways (18.8, 18.9) along their lengths.

Spraying means, designated generally as 20 in FIG. 2, are disposed within the spray compartment below the incoming air passageways (18.8, 18.9). The spraying means comprises one or more spray guns (20.1, 20.2) mounted on a movable carriage (20.3). A generally horizontal track (20.4) extends across the interior of the spray compartment between the side walls (16.7, 16.8) and below the incoming air passageways (18.8, 18.9) as shown best in FIG. 2, and serves to guide the carriage (20.3) as the latter traverses the spray compartment from side-to-side. Hydraulic, pneumatic or mechanical means (not shown) of known design are employed to cause the carriage (20.3) to reciprocate back and forth across the spray compartment. The spray guns, carriage, track and hydraulic, pneumatic or mechanical reciprocation means may be of a design known to the art, and need not be described in further detail.

Deflector plates (19.2, 19.3) extend generally inwardly and downwardly from the front and rear walls (18.1, 18.2) of the spray compartment, and have upwardly and inwardly facing walls that converge downwardly toward the spray heads (20.1, 20.2) to narrow or constrict the openings (19.4, 19.5) through which downwardly flowing air flows past the spray heads.

With reference to FIG. 2, it will be noted that the front and rear walls (16.4, 16.5) are closely adjacent the upper surface of a workpiece "C" conveyed beneath the housing. The front and rear walls (18.1, 18.2) of the spray compartment terminate downwardly in edges (19.6, 19.7) disposed adjacent the upper surface of the workpiece "C" but above the level of the lower edges (16.9, 17) of the front and rear housing walls, thereby providing passageways (19.8, 19.9) for air from within the spray compartment to enter the exhaust passageways (18.4, 18.5), respectively. This configuration of the lower edges of the walls causes downwardly flowing air within the spray compartment to undergo an abrupt change of direction in the passageways (19.8, 19.7), as shown by the arrows in FIG. 2.

Figure 3:
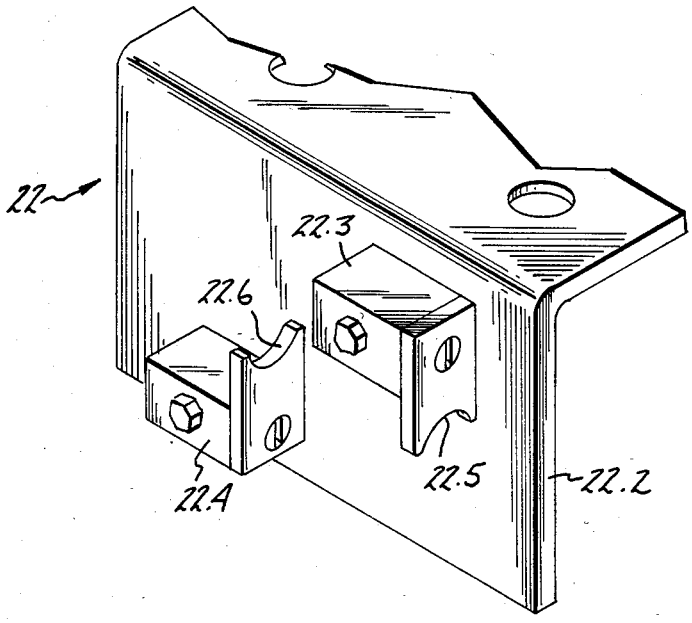
FIG. 3 is a broken-away view of a scraper device shown also in FIGS. 1 and 2.

Mounted on either side of the bath (16) are scraping devices, one of which is depicted in detail in FIG. 3. The cords (14.1, 14.2), representing conveyor means for conveying workpiece "C" through the spray station beneath the spray heads, may be made of reinforced polyurethane or the like, and normally have round cross-sections. The scrapers designated 22, 22.1, are carried forwardly and rearwardly of the bath adjacent the top edges of the bath tank (14.7), and may be attached to the tank or to the framework (not shown) supporting the above-described apparatus. Referring to FIG. 3, the scraper comprises a supporting plate (22.2) to which are affixed scraper blocks (22.3, 22.4, respectively). The blocks are provided respectively with attached plates having oppositely facing semi-circular grooves (22.5, 22.6) with sharp edges, the blocks being aligned on the plate (22.2) as shown in FIG. 3 so that a cord passing within the semi-circular grooves will have its upper semi-circular surface scraped by the plate of block (22.3) and its lower semi-circular surface scraped by the plate of block (22.6).

In operation, the blower (16.3) provides air to the incoming air passageways (18.8, 18.9) of the spray compartment, the air flowing downwardly through the passageways (19.4, 19.5) adjacent the spray guns. It will be understood that the velocity of the air as it passes through the narrowed passages (19.4, 19.5) is increased. A material to be sprayed, such as a latex adhesive, is forced through the spray guns (20.1, 20.2) and is sprayed downwardly as depicted in the drawing toward the upper surface of the workpiece "C". Water based adhesive systems of this type in particular have shown a tendency to form a "mist" of liquid adhesive particles within a spray compartment, the particles eventually becoming adherred to internal surfaces of the spray compartment and, indeed, upon the spray guns themselves, and further escaping to the surrounding work area. By maintaining a rapid flow of air downwardly through the narrowed passages (19.4, 19.5) adjacent the spray guns in the instant invention, the mist becomes entrained in the downward flow of air and is prevented from moving upwardly into contact with the spray gun means.

The air-entrained particulate mist is then carried through the passageways (19.8, 19.9) beneath the lower edges (19.6, 19.7) of the front and rear walls of the spray compartment. The entrained particles thus undergo a rapid change of direction from a first direction generally downwardly toward the workpiece spraying station to a second direction generally away from the workpiece spraying station and upwardly through the exhaust passageways (18.4, 18.5). The downward momentum of the particles appears to cause many of the particles that otherwise would be exhausted to contact and adhere to the workpiece in the vicinity of the lower edges (19.6, 19.7) of the front and rear walls of the spray compartment, thereby reducing the quantity of particles that would be lost and hence increasing the efficiency of the spraying operation. The particles remaining in the upward air flow through the exhaust passageways (18.4, 18.5) are filtered from the air by the replaceable filters (18.6, 18.7), and the filtered air is exhausted through the exhaust port (16.2).

The blower (16.31) is installed in the exhaust port (16.2) to improve air flow in the system. The use of an exhaust blower in this manner creates reduced pressure (sub-atmospheric) in the exhaust passageways (18.4, 18.5) and will reduce the amount of sprayed material that escapes from the housing beneath its edges.

The bath (16) into which the cords (14.1, 14.2) are immersed desirably contains a solvent or dispersant for the sprayed liquid. If a water-based emulsion of adhesive particles is employed as the sprayed liquid, then the bath (16) may be of water. To the extent that adhesive particles are deposited upon the cords, the same may be scraped from the cords by the scrapers (22, 22.1) as the cords pass therethrough, the water bath tending to disperse those particles as remain adherred to the cords after they pass through the scraper (22.1). The cords and bath into which they are immersed thus provide a self-cleaning system for the cords.

By use of the instant invention, one may maintain the spray gun means and the surrounding work area substantially free of particle deposition, thereby greatly reducing maintenance and down time of the apparatus and further reducing pollution of the surrounding area. Further, the rapid change of direction afforded the air-entrained mist encourages the particles to become adherred to the workpiece, and thus tends to reduce the concentration of particles in the exhausted air. The filters (18.6, 18.7), which are replaceable, filter the particles from the exhausted air and reduce or substantially eliminate air pollution in the vicinity of the apparatus.

INDUSTRIAL APPLICABILITY

The present invention has particular utility and applicability for industrial machines employed in the manufacture of kitchen countertops, desk tops, flooring, partitions and the like. The invention reduces maintenance time and expense for spraying apparatuses, and tends to improve spraying efficiency and to reduce air pollution.

While a preferred embodiment of the present invention has been described, it should be understood that various changes, adaptations, and modifications may be made therein without departing from the spirit of the invention and the scope of the appended claims.

What is claimed is:

1. Spraying apparatus for applying sprayed particles upon a workpiece comprising means defining a spray compartment having a workpiece-spraying station, spray gun means in the compartment for spraying particles onto a workpiece in the workpiece spraying station, and exhaust means for exhausting air-entrained sprayed particles from the spray compartment, the apparatus being characterized by means providing a rapid flow of air past the spray gun means generally toward the workpiece spraying station of sufficient velocity as to prevent sprayed, air-entrained particles from depositing on the spray gun means, and the spray compartment including walls having edges adjacent the workpiece spraying station and defining means cooperating with a workpiece in the workpiece spraying station to abruptly change the direction of air containing sprayed entrained particles from a first direction generally toward the workpiece spraying station about said edges to a second direction generally away from the workpiece spraying station, whereby air-entrained particles are urged into contact with the workpiece.

2. The spraying apparatus of claim 1 including conveyor means for conveying a workpiece continuously into and out of the workpiece spraying station.

3. The spraying apparatus of claim 2 in which the conveyor means comprises continuous cords, the apparatus including a liquid bath, means for immersing the cords into the bath, and means for scraping particles from the cords as they exit from the bath.

4. A spraying apparatus for applying sprayed particles to the surface of a workpiece comprising means defining a spray compartment having a workpiece spraying station; spray gun means in the compartment for spraying particles onto a workpiece in the spraying station; means for supplying air under superatmospheric pressure to the spray compartment and for directing said air over and past the spray gun means generally toward the workpiece spraying station to prevent sprayed particles from depositing on the spray gun means, exhaust means creating a partial vacuum adjacent the workpiece spraying station to exhaust particle-laden air from adjacent the workpiece and to thereby reduce the escape of particle-laden air from the spraying apparatus, and means for abruptly changing the direction of particle-laden air adjacent a workpiece in the spraying station from a first direction generally toward the spraying station to a second direction generally away from the spraying station.

5. The spraying apparatus of claim 4 wherein said spray compartment includes walls having edges adjacent the workpiece spraying station defining said means for abruptly changing the direction of particle-laden air adjacent a workpiece.

6. A spraying apparatus for spraying an aqueous liquid upon a workpiece comprising a spray compartment having a downwardly oriented opening defining a workpiece spraying station, spray gun means within the spray compartment and oriented to spray the liquid downwardly toward the spraying station, conveyor means for conveying a workpiece to be sprayed past the spraying station, means supplying air at superatmospheric pressure to the spray compartment above the spray gun means to create a generally downwardly flow of air past the spray gun means with sufficient velocity as to entrain particles of the sprayed liquid and to substantially prevent the same from depositing upon the spray gun means, and exhaust means having means defining downwardly open exhaust passageways about the spray chamber means for exhausting particle-laden air from adjacent the spraying station, and exhaust blower means for maintaining the downwardly open passageways at sub-atmospheric pressure, the passageways having lower edges closely adjacent the conveyor means and the spray compartment means having lower edges adjacent but spaced above the conveyor means to define exhaust paths providing the particle-laden air from the spray chamber means with a rapid change of direction from a first direction generally toward the workpiece spraying station to a second direction generally away from the workpiece spraying station.

* * * * *